United States Patent [19]

Hongel

[11] Patent Number: 4,658,320

[45] Date of Patent: Apr. 14, 1987

[54] SWITCH CONTACT ARC SUPPRESSOR

[75] Inventor: Chester C. Hongel, Brush Prairie, Wash.

[73] Assignee: ElecSpec Corporation, Vancouver, Wash.

[21] Appl. No.: 709,930

[22] Filed: Mar. 8, 1985

[51] Int. Cl.[4] ..... H01H 9/30

[52] U.S. Cl. ..... 361/13; 361/58

[58] Field of Search ..... 361/2, 6, 8, 10, 13, 361/58, 100; 307/134, 135, 137

[56] References Cited

U.S. PATENT DOCUMENTS

| | | | |
|---|---|---|---|
| 3,339,110 | 8/1967 | Jonco, Jr. | 361/13 |
| 3,430,063 | 2/1969 | Webb | 361/6 X |
| 3,539,775 | 11/1970 | Casson | 361/13 X |
| 3,639,808 | 2/1972 | Ritzow | 307/137 |
| 3,783,305 | 1/1974 | Lefferts | 361/10 X |
| 3,982,137 | 9/1976 | Penrod | 361/8 |
| 4,420,784 | 12/1983 | Chen et al. | 361/13 X |
| 4,438,472 | 3/1984 | Woodworth | 361/2 X |
| 4,466,038 | 8/1984 | Robertson | 361/8 |
| 4,500,934 | 2/1985 | Kinsinger | 361/13 X |

*Primary Examiner*—A. D. Pellinen

*Assistant Examiner*—Derck S. Jennings

*Attorney, Agent, or Firm*—Dellett, Smith-Hill & Bedell

[57] ABSTRACT

An arc suppression circuit for a switch carrying a load current includes a MOSFET having a drain connected to a first contact of the switch and a source connected to a second contact of the switch. A biasing capacitor is coupled at one end to the drain and at another end through a damping resistor to the gate, such that when the switch contacts are opened, the interrupted load current passes through the biasing capacitor to charge an inherent gate-to-source MOSFET capacitance for turning on the MOSFET and shunting the load current around the switch. A biasing resistor, connected between the gate and the source of the MOSFET, subsequently discharges the gate-to-source capacitance, turning off the MOSFET and terminating the shunted load current after the contacts of the switch have separated by a distance sufficient to preclude arcing. A zener diode, having its cathode connected to the gate of the MOSFET and its anode connected to the source of the MOSFET, quickly discharges the biasing capacitor when the switch contacts are reclosed.

15 Claims, 5 Drawing Figures

SWITCH CONTACT ARC SUPPRESSOR

BACKGROUND OF THE INVENTION

The invention disclosed relates in general to switching devices and in particular to circuits for suppressing arcs which may occur upon switch operation.

There is a significant need for controlling high voltage direct or alternating currents with a physically small switching device, such as a relay. The problem involved in satisfying this need, however, is that as the contacts of a relay are opened, an electrical discharge occurring where current flow is interrupted causes heating and burning of the electrodes, leading to welding and destruction thereof. One attempt to solve this problem is disclosed in U.S. Pat. No. 4,438,472 to Woodworth, as depicted in FIG. 1 therein, wherein the contacts of a switch S1 are shunted by a bipolar transistor Q1 for diverting a load current around the mechanical switch when the contacts are opened. Such current is diverted long enough to enable the contacts to be separated by a distance sufficient to prevent arcing.

The transistor in Woodworth is turned on as the switch opens as a result of current applied to the base of the transistor through a biasing capacitor C1, and is turned off after the contacts become widely separated when the biasing capacitor has charged. Arcing is avoided when contact bounce occurs upon closure of the contacts by providing a diode D1 connected in parallel with the base-emitter portion of the circuit. Diode D1 discharges the biasing capacitor upon the first closure of the contacts, permitting flow of current to the transistor base as the contacts thereafter bounce apart for again turning on the transistor and shunting the arcing current around the contacts.

While the arc suppressing circuit disclosed by Woodworth functions adequately in some applications, it suffers from drawbacks making it impractical in others. First, since the base input impedance of a bipolar transistor is relatively low, the size of the biasing capacitor must be fairly large in order for the transistor to stay on long enough to provide arc suppression for an adequate contact separation time. For example, Woodworth discloses a typical application wherein a one microfarad biasing capacitor is necessary to permit the transistor to remain on for a period of one millisecond. The large capacitor adds expense to the device and increases the size of the packaging required, making the Woodworth arc suppression circuit less suitable for use in conjunction with micro-relays where small packaging is necessary.

Another drawback associated with the Woodworth suppression circuit relates to the relatively high active state collector-to-emitter impedance of the typical bipolar transistor. During arc suppression, the current shunted through this high impedance path generates waste heat which can cause equipment failure, particularly when the contacts are opened and closed frequently. Additional heat sinking provisions, necessary to permit high duty cycle operation of the transistor, can cause further increases in packaging size and expense.

Finally, the Woodworth suppression circuit is only suitable for use in conjunction with direct current switching operations.

What is needed, and would be useful, is a contact arc suppression circuit which could be implemented in a small package, which would generate little heat during arc suppression and which could be used in conjunction with either AC or DC current switcing applications.

SUMMARY OF THE INVENTION

According to one aspect of the invention, a DC arc suppression circuit employs a metal-oxide-semiconductor field-effect-transistor (MOSFET) for actively shunting a load current around the contacts of a switching device as the contacts are opened. The load current is shunted for a period of time long enough to enable the contacts to separate a sufficient distance to prevent arcing. In the active state, the MOSFET has low drain-to-source impedance compared to the collector-to-emitter impedance of a saturated bipolar transistor and only comparatively small amounts of heat are generated by the MOSFET during arc suppression.

According to another aspect of the invention, when the switch contacts are opened under load, the load current is shunted through a biasing capacitor to the gate of the MOSFET, thereby charging the gate-to-source capacitance of the MOSFET and turning on the MOSFET. As the biasing capacitor charges and the gate-to-source capacitance discharges through a biasing resistor, the gate voltage falls and the MOSFET turns off. Since the gate capacitance charging current drawn by the MOSFET during arc suppression is much lower than the base current drawn by a bipolar transistor, the biasing capacitor used in conjunction with the MOSFET arc suppression circuit of the present invention is much smaller than the biasing capacitor used in conjunction with a bipolar transistor arc suppression circuit of the prior art.

According to still another aspect of the invention, a logic level power MOSFET is employed wherein a relatively low gate voltage is required to turn on the MOSFET. This permits a further reduction in the size of the biasing capacitor.

According to yet another aspect of the invention, the gate of the MOSFET is coupled to the biasing capacitor and a biasing resistor through an attenuating resistor to limit feedback from the drain of the MOSFET, thereby preventing MOSFET switching oscillation.

According to a further aspect of the invention, the biasing resistor is shunted by a zener diode, the diode providing a path for rapidly discharging the biasing capacitor when the contacts are closed and, in the reverse direction, for providing a path for currents due to high voltage transients across the contacts, thereby limiting the transient voltage applied to the MOSFET gate and protecting the MOSFET from damage.

According to a still further aspect of the invention, an internal pn junction coupling the drain and source terminals of the MOSFET provides a shunting path for reverse arcing currents as may sometimes occur during the initial moments of contact opening, depending on the nature of the load. A similar pn junction is not available between the emitter and collector of a bipolar transistor.

In regard to an additional aspect of the invention, two DC arc suppression circuits are connected in a series fashion across a switch contact to provide arc suppression for AC switch currents.

Accordingly it is an object of the present invention to provide a new and improved apparatus for suppressing arcing currents during DC or AC circuit contact opening wherein said apparatus may be incorporated in a small package.

It is another object of the present invention to provide a new and improved apparatus for suppressing arcing currents during AC or DC circuit contact opening wherein said apparatus generates relatively small amounts of heat during arc suppression.

It is yet another object of the present invention to provide a new and improved apparatus for suppressing reverse arcing currents during DC circuit contact opening.

It is a further object of the present invention to provide a new and improved apparatus for suppressing arcing currents during AC or DC circuit contact opening wherein said apparatus is not subject to damage due to transient voltages across the contacts.

The subject matter of the present invention is particularly pointed out and distinctly claimed in the concluding portion of this specification. However, both the organization and method of operation, together with further advantages and objects of the present invention, may best be understood by reference to the following description taken in connection with accompanying drawings wherein like reference characters refer to like elements.

DRAWINGS

FIG. 1 is a schematic diagram of a DC arc suppressing circuit according to a preferred embodiment of the present invention, FIGS. 2A–2C are waveform diagrams illustrating the operation of the arc suppressing circuit of FIG. 1, and FIG. 3 is a schematic diagram of an AC arc suppressing circuit according to an alternative embodiment of the present invention.

DETAILED DESCRIPTION

Figure 1:
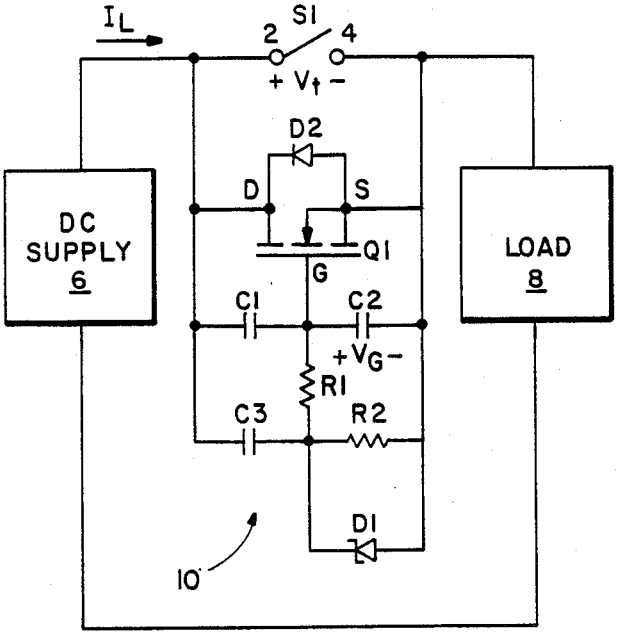

Referring to FIG. 1, an arc suppressing circuit 10, illustrated in schematic diagram form, is adapted to prevent arcing across contacts 2 and 4 of switch device S1 as contacts 2 and 4 are separated to break a load current $I_l$ flowing from D.C. supply 6 to load 8.

Figure 2A:
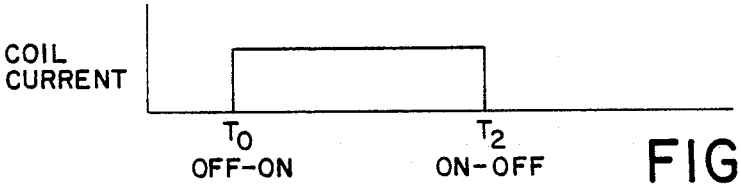
Figure 2B:
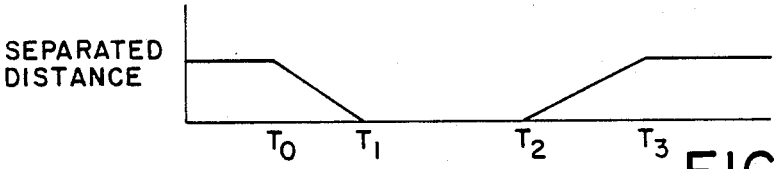
Figure 2C:
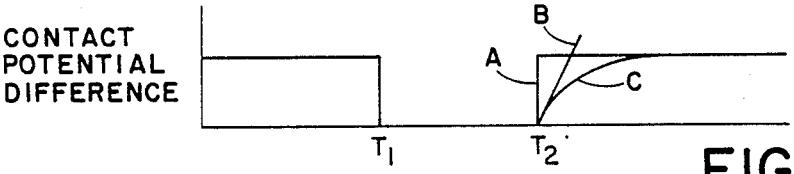

Switch device S1 may be contained in a relay wherein the switch is closed by energizing a coil in the relay and is opened by de-energizing the relay coil, although in other embodiments switch device S1 may be operated by other means. The purpose of the arc suppressing circuit 10 of the present invention is illustrated with reference to the curves shown in FIG. 2. FIG. 2A is a waveform diagram of the current through the relay coil. At time T0 the relay current is turned on to close the switch contacts, and at time T2 the relay current is turned off to open the contacts. In the waveform diagram of FIG. 2B, the separation distance between the relay contacts is plotted as a function of time. At the time T1 following the time T0, the switch contacts are completely closed. At time T2, when the magnetic flux of the relay coil begins to collapse as a result of turning off the coil current, the separation distance between the contacts begins to increase and the contacts are fully open at time T3. As can be seen in waveform diagram FIG. 2C, the potential difference between the switch contacts abruptly changes from the full power supply potential to zero potential at time T1, when the contacts are closed. In the first instance, without the circuit disclosed herein, curve A in waveform diagram of FIG. 2C illustrates the abrupt increase in the potential difference between the contacts at the time T2 when the switch contacts just begin to open. This abrupt increase in the potential difference across the contacts creates a field strength in the region between the contacts which is greater than that field strength required for arcing. The minimum contact potential required for arcing, as a function of time, in this relay, is shown by curve B of FIG. 2C. Curve C of FIG. 2C shows the resulting potential difference across the contacts which occurs with the use of the arc suppressing circuit 10. It can be seen that at all times following T2, the potential difference across the contacts with arc suppression circuit 10 in place is less than that which would cause arcing, such that the contacts of the relay are protected from arcing.

The arc suppressing circuit of FIG. 1 comprises a MOSFET Q1 having a drain terminal D connected to terminal 2 of switch S1, and a source terminal S connected to terminal 4 of switch S1, for actively shunting a load current $I_L$ around switch S1 as the contacts are opened. The load current is shunted for a period of time long enough to enable the contacts to separate by a sufficient distance to prevent arcing. The internal drain-to-gate and gate-to-source capacitances of MOSFET Q1 are depicted in FIG. 1 as C1 and C2 respectively. An internal pn junction between the source and drain of MOSFET Q1 (which is normally reverse biased and therefore nonconducting) is represented as diode D2.

The arc suppressing circuit of FIG. 1 further comprises biasing capacitor C3 and biasing resistor R2 connected in series, one end of biasing capacitor C3 being connected to the drain of MOSFET Q1 and one end of resistor R2 being connected to the source of MOSFET Q1. Parasitic attenuating resistor R1 couples the interconnected terminals of biasing capacitor C3 and biasing resistor R2 to gate terminal G of MOSFET Q1. Zener diode D1 is connected in parallel with biasing resistor R2 such that the anode of diode D1 is coupled to the source of MOSFET Q1.

The state of MOSFET Q1 is controlled by the gate-to-source voltage $V_g$ appearing across the internal MOSFET gate-to-source capacitor C2. When $V_g$ rises above a threshold level (e.g. 2.5 volts) depending on the characteristics of the MOSFET used, the MOSFET Q1 turns on, permitting conduction from drain to source. With switch S1 closed, capacitor C2 is discharged, the gate-to-source voltage is zero and MOSFET Q1 remains in a nonconducting state. C3 and C1 are also discharged through S1 and D1.

When S1 is opened, a voltage $V_t$ appears across the terminals 2 and 4 of switch S1. This voltage is normally low at the instant of contact opening, being prevented from abruptly rising to the DC supply voltage by the internal capacitances and inductances of the DC supply 6, the load 8, and the interconnecting wiring. Assuming R1 is negligibly small (e.g. 100 Ohms), and that the gate-to-source impedance of MOSFET Q1 is high, $V_g$ is proportional to $V_t$, with the proportion being determined by the voltage divider comprising parallel capacitors C1 and C3 in series with the parallel combination of C2 and R2. With C1 and C2 being typically in the range of 150 and 750 picofarads, respectively, with C3 being selected to be approximately 1000 picofarads, and with R2 being relatively large, $V_g$ will reach the approximately 2.5 volts necessary to turn on MOSFET Q1 when $V_t$ reachs approximately 5 volts, thereby retarding the rate at which voltage $V_t$ increases and thwarting development a field strength sufficient to cause an arcing current through the switch. It will be seen that C2 is essentially charged through C3 for turning on the MOSFET long enough to prevent arcing.

Since the inherent gate-to-source capacitance C2 associated with MOSFET Q1, along with the gate-to-source turn on voltage, are small, capacitor C3 may also be small. Logic level MOSFETs permit gate-to-source turn on voltages of approximately 2.5 volts and have gate-to-source capacitance as low as 150 picofarads.

As contacts 2 and 4 further separate, and as $V_t$ continues to increase toward the supply voltage, capacitors C1, C2 and C3 continue to charge. The voltage across C3 will rise, as it must supply the current necessary to keep C2 from discharging through R2, whereby the MOSFET continues in an on state. As the voltage across C3 rises, so does the voltage across the MOSFET, but at a rate such that the contacts do not arc. Capacitor C3 will completely charge to the power supply voltage through R2, while C2 will begin discharging through R2. Eventually, C2 will discharge below the 2.5 volt threshold voltage, the MOSFET Q1 turns off. By this time, contacts 2 and 4 are far enough apart that arcing will not occur across the contacts. The R2C2 time constant enables adequate separation time.

When contacts 2 and 4 of switch S1 are reclosed, capacitors C1 and C3 rapidly discharge through the contacts and zener diode D1, thereby preparing the arc suppression circuit for subsequent switch reopening. The rapid discharge of C1 and C3 on reclosing S1 permits suppression of arcing as might otherwise occur during contact bounce. In addition to providing a discharge path for C1 and C3 when S1 is closed, zener diode D1 also protects the gate of MOSFET Q1 from damage by transient voltages which may occur across the contacts of S1 while S1 is open by limiting the gate voltage.

In some applications, particulary when load 8 is highly inductive, the voltage $V_t$ across terminals 2 and 4 may temporarily develop having a polarity reversed from what might normally be expected, with terminal 4 being higher in voltage than terminal 2. In this case pn junction D2 of the MOSFET is forward biased and provides a low impedance path for current passing from the load 8 to the supply 6, thereby limiting the magnitude of the reverse polarity contact voltage and suppressing arcing across the switch S1 terminals until the voltage across the terminals changes polarity.

Resistor R1 is provided to dampen parasitic oscillations in MOSFET gate voltage Vg as may occur when the load 8 or interconnecting wiring is inductive. This inductance appears in parallel with the capacitance of the arc suppressing circuit when viewed from the gate of MOSFET Q1 and such parallel combination can cause unstability in Vg in the absence of the damping resistor.

Active arc suppression circuits in accordance with the present invention improve contact life span and reliability of mechanical switching contacts which must switch large DC currents by eliminating contact arcing through the gradual reduction of the load current when the relay contacts are opened. This avoids interruption of the full load current as would produce a significant arc across the contacts. The DC arc suppressing circuit 10 of FIG. 1 also enables the use of small relays for direct current switching at their full AC voltage and current ratings. Virtually no power is dissipated by the relay circuit either when the contacts are closed or during arc suppression, something not previously possible in the prior art. Further, the suppression circuits of the present invention may be implemented in a compact form so as to permit their use with a small relay because capacitor C3 can be small in view of the high gate-to-source impedance of the MOSFET.

Figure 3:
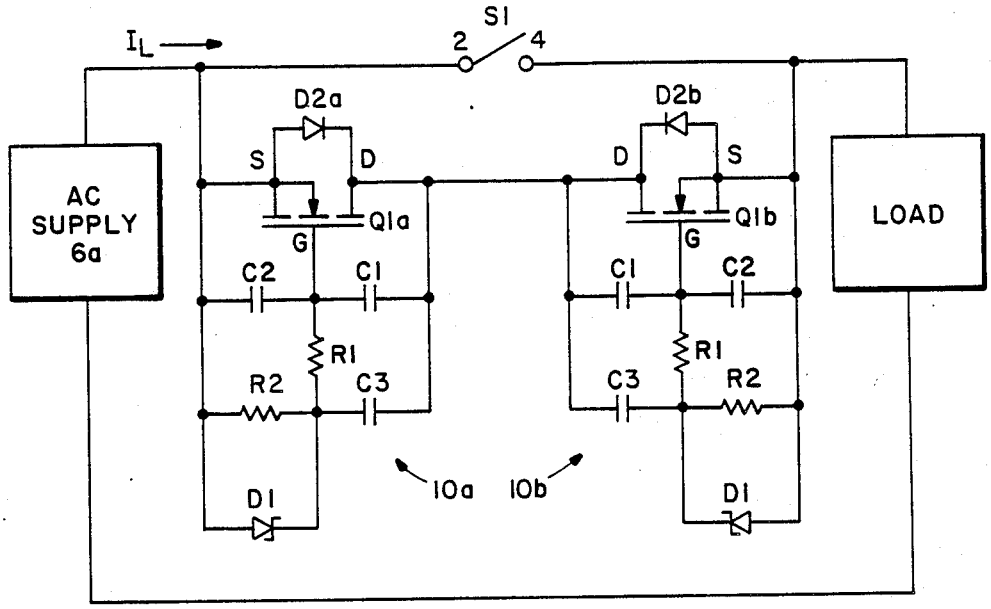

FIG. 3 shows an alternative embodiment of the present invention for providing arc suppression when AC currents from AC supply 6*a* are switched by switch S1. A pair of DC arc suppression circuits 10*a* and 10*b* are connected in series across the contacts of switch S1 with suppression circuits 10*a* and 10*b* being substantially identical to DC suppression circuit 10 of FIG. 1. The source of MOSFET Q1*a* of suppression circuit 10*a* is connected to terminal 2 of switch S1 while the drain of MOSFET Q1*a* is connected to the drain of MOSFET Q1*b* of suppression circuit 10*b*. The source of MOSFET Q1*b* is connected to terminal 4 of switch S1. When terminal 2 of switch S1 is positive with respect to terminal 4, diode D2*a* is forward biased, allowing arcing currents to bypass suppression circuit 10*a*. Circuit 10*b* then provides arc suppression in a manner similar to that described in connection with circuit 10 of FIG. 1. Alternatively, when terminal 4 of switch S1 is positive with respect to terminal 2, diode D2*b* of suppression circuit 10*b* is forward biased, allowing arcing currents to bypass suppression circuit 10*b*. Circuit 10*a* then provides arc suppression in the manner of circuit 10 of FIG. 1.

While preferred and alternative embodiments of the present invention have been shown and described, it will be apparent to those skilled in the art that many changes and modifications may be made without departing from the invention in its broader aspects. For instance, while n-channel MOSFETs have been illustrated in FIGS. 1 and 3, p-channel MOSFETs could be utilized in a similar circuit arrangement. The appended claims are therefore intended to cover all such changes and modifications as fall within the true spirit and scope of the invention.

I claim:

1. An arc suppression circuit used with a switch carrying a load current, said switch having first and second contacts, said circuit comprising:

a MOSFET having a drain, and means for coupling the drain to said first contact of said switch, said MOSFET having a source, and means for coupling the source to said first contact of said switch, said MOSFET having a source, and means for coupling the sourcre to said second contact of said switch, said MOSFET also having a gate, and an inherent gate-to-source capacitance, capacitor means for charging said gate-to-source capacitance when said first and second switch contacts are opened and are at differing potentials such that the MOSFET turns on, said MOSFET shunting the load current around said switch contacts, and resistance means for discharging said gate-to-source capacitance such that the MOSFET turns off after it turns on thereby terminating load current shunting.

2. An arc suppression circuit as in claim 1 wherein said resistance means of discharging comprises:

a biasing resistor coupled at one end to said gate and at another end to the source of said MOSFET.

3. An arc suppression circuit as in claim 1 wherein said charging means comprises:

a biasing capacitor coupled at one end to said drain and at the other end to said gate such that when said switch contacts are opened said load current passes through said biasing capacitor to said gate-to-source capacitance to charge said gate-to-source capacitance thereby turning on said MOSFET.

4. An arc suppression circuit as in claim 3 further comprising:

a diode having its cathode coupled to said gate of said MOSFET and its anode coupled to said source of said MOSFET, for quickly discharging said biasing capacitor when said switch contacts are closed.

5. An arc suppresion circuit as in claim 4 wherein said diode comprise a zener diode.

6. An arc suppression circuit used with a switch carrying a load current, said switch having first and second contacts, said circuit comprising:

a MOSFET having a drain, and means for coupling the drain to said first contact of the switch, said MOSFET having a source, and means for coupling the source to said second contact of the switch, said MOSFET also having a gate, and an inherent gate-to-source capacitance, a damping resistor, and a biasing capacitor coupled at one end to said drain and at the other end through said damping resistor to said gate, such that when the said switch contacts are opened and are at differing potentials, said load current passes through said biasing capacitor and damping resistor to said gate-to-source capacitance to charge said gate-to-source capacitance, turning on the MOSFET whereby the MOSFET shunts the load current around the switch contacts.

7. An arc suppression circuit as in claim 6 further comprising:

a biasing resistor connected between said other end of said biasing capacitor and said MOSFET source for discharging said gate-to-source capacitance, such that said MOSFET turns off after it turns on.

8. An arc suppression circuit as in claim 7 further comprising:

a diode connected in parallel with said biasing resistor for quickly discharging said biasing capacitor when said switch contacts are closed.

9. An arc suppression circuit used with a switch carrying a load current, said switch having first and second contacts, said current comprising:

a MOSFET having a drain, and means for coupling the drain to said first contact of the switch, a source, and means for coupling the source to said second contact of the switch, said MOSFET also having a gate, and an inherent gate-to-source capacitance, a damping resistor, a biasing capacitor coupled at one end to said drain and at the other end through said damping resistor to said gate, such that when the said switch contacts are opened and are at differing potentials, load current passes through said biasing capacitor and said damping resistor to charge said gate-to-source capacitance, thereby turning on the MOSFET whereby the MOSFET shunts the load current around the switch contacts, a biasing resistor connected between said other end of said biasing capacitor and said MOSFET source for discharging said gate-to-source capacitance such that said MOSFET turns off after it turns on, and a zener diode connected in parallel with said biasing resistor for quickly discharging said biasing capacitor when said switch contacts are closed.

10. An arc suppression circuit used with a switch carrying an AC load current, said switch having first and second contacts, said circuit comprising:

a first MOSFET having a source, a drain, and a source-to-drain diode, and a second MOSFET having a source, a drain, and a source-to-drain diode, the first and second MOSFET being connected in series fashion across said switch contacts such that when either one of the MOSFETs turns on, the AC load current is shunted through the drain and source of the turned on MOSFET and through the drain-to-source diode of the other MOSFET.

11. An arc suppression circuit used with a switch carrying an AC load current, said switch having first and second contacts, said circuit comprising:

a first MOSFET having a source, a drain, a gate, an inherent gate-to-source capacitance, and a source-to-drain diode, a second MOSFET having a source, a drain, a gate, an inherent gate-to-source capacitance, and a source-to-drain diode, means connecting the first and second MOSFETs in series across the switch contacts such that when either of the MOSFETs turns on the AC load current is shunted through the drain-to-source diode of the other MOSFET and through the drain and source of the turned on MOSFET, first means to charge said gate-to-source capacitance of said first MOSFET when the switch contacts are opened with the second contact at a higher potential than the first contact so that the first MOSFET turns on and shunts the load current around said switch contacts through said source-to-drain diode of said second MOSFET and through said first MOSFET, and second means to charge said gate-to-source capacitance of said second MOSFET when the switch contacts are opened with said first contact at a higher potential than said second contact so that the second MOSFET turns on to shunt the load current around said switch contacts through said source-to-drain diode of said first MOSFET and through said second MOSFET.

12. An arc suppression circuit as in claim 11 wherein said first and second charging means comprise:

a first biasing capacitor coupled at one end to said first MOSFET drain and at another end to said first MOSFET gate, such that when said switch contacts are opened with said second contact at a higher potential than said first contact, said load current passes through said first biasing capacitor to charge said first MOSFET gate-to-source capacitance, and a second biasing capacitor coupled at one end to said second MOSFET drain and at another end to said second MOSFET gate, such that when said switch contacts are opened with said first contact at a higher potential than said second contact, said load current passes through said second biasing capacitor to charge said second MOSFET gate-to-source capacitance.

13. An arc suppression circuit as in claim 12 further comprising:

a first zener diode having a cathode coupled to said gate of said first MOSFET and an anode coupled to said source of said first MOSFET for discharging said first biasing capacitor when said switch contacts are closed, and a second zener diode having a cathode connected to said gate of said second MOSFET and an anode connected to said source of said second MOSFET for discharging said second biasing capacitor when said switch contacts are closed.

14. An arc suppression circuit used with a switch carrying an AC load current, said switch having first and second contacts, said circuit comprising:

a first MOSFET having a source, a drain, a gate, an inherent gate-to-source capacitance, and a source-to-drain diode, a second MOSFET having a drain, a source, a gate, an inherent gate-to-source capacitance, and a source-to-drain diode, means connecting the first and second MOSFETs in series across the switch such that when either one of the MOSFETs turns on, the load current is shunted through the drain-to-source diode of the other MOSFET and through the drain and source of the turned on MOSFET, a first biasing resistor, having one end coupled to said gate and another end coupled to said source of said first MOSFET, for discharging said gate-to-source capacitance of said first MOSFET, a second biasing resistor, having one end coupled to said gate and another end coupled to said source of said second MOSFET, for discharging said gate-to-source capacitance of said second MOSFET, a first biasing capacitor coupled at one end to said first MOSFET drain and at another end to said first MOSFET gate, such that when the said switch contacts are opened with said second switch contact at a higher potential than said first switch contact, said load current passes through said first biasing capacitor and said second MOSFET source-to-drain diode to charge said first MOSFET gate-to-source capacitance, a second biasing capacitor coupled at one end to said second MOSFET drain and at another end to said second MOSFET gate, such that when the said switch contacts are opened with said first contact at a higher potential than said second contact, said load current passes through said second biasing capacitor and said first MOSFET source-to-source diode to charge said second MOSFET gate-to-source capacitance, a first zener diode, coupled in parallel with said first biasing resistor, for discharging said first MOSFET biasing capacitor when said switch contacts are closed, a second zener diode, coupled in parallel with said second biasing resistor, for discharing said second MOSFET biasing capacitor when said switch contacts are closed, a first damping resistor, said first biasing capacitor being coupled to said first MOSFET gate through said first damping resistor, and a second damping resistor, said second biasing capacitor being coupled to said second MOSFET gate through said second damping resistor.

15. An arc suppression circuit used with a switch carrying an AC load current, said switch having first and second contacts, said circuit comprising:

a first MOSFET having a source, a drain, a gate, an inherent gate-to-source capacitance, and a source-to-drain diode, a second MOSFET having a source, a drain, a gate, an inherent gate-to-source capacitance, and a source-to-drain diode, means connecting the first and second MOSFETs in series across the switch contacts such that when either of the MOSFETs turns on the AC load current is shunted through the source-to-drain diode of the other MOSFET and through the drain and source of the turned on MOSFET, first means to charge said gate-to-source capacitance of said first MOSFET when the switch contacts are opened with the second contact at a higher potential than the first contact so that the first MOSFET turns on and shunts the load current around said switch contacts through said source-to-drain diode of said second MOSFET and through said first MOSFET, second means to charge said gate-to-source capacitance of said second MOSFET when the switch contacts are opened with said first contact at a higher potential than said second contact so that the second MOSFET turns on to shunt the load current around said switch contacts through said source-to-drain diode of said first MOSFET and through said second MOSFET, a first biasing resistor coupled at one end to said gate and at another end to said source of said first MOSFET for discharging said first MOSFET gate-to-source capacitance, and a second biasing resistor connected between said gate and said source of said second MOSFET for discharging said second MOSFET gate-to-source capacitance.

* * * * *

UNITED STATES PATENT AND TRADEMARK OFFICE

CERTIFICATE OF CORRECTION

PATENT NO. : 4,658,320

DATED : April 14, 1987

INVENTOR(S) : Chester C. Hongel

It is certified that error appears in the above-identified patent and that said Letters Patent is hereby corrected as shown below:

Column 5, line 18, "the" (second occurrence) should be --and--.

Column 6, delete lines 43 and 44;

line 46, "sourcre" should be --source--;

line 61, "of" should be --for--.

Column 7, line 46, "current" should be --circuit--.

Column 8, line 11, "MOSFET" should be --MOSFETs--.

Signed and Sealed this

First Day of March, 1988

*Attest:*

*Attesting Officer*

DONALD J. QUIGG

*Commissioner of Patents and Trademarks*